US008075839B2

(12) United States Patent
Srivastava

(10) Patent No.: US 8,075,839 B2
(45) Date of Patent: Dec. 13, 2011

(54) COBALT-CHROMIUM-IRON-NICKEL ALLOYS AMENABLE TO NITRIDE STRENGTHENING

(75) Inventor: S. Krishna Srivastava, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 1025 days.

(21) Appl. No.: 11/521,911

(22) Filed: Sep. 15, 2006

(65) Prior Publication Data

US 2008/0066831 A1 Mar. 20, 2008

(51) Int. Cl.
*C22C 19/07* (2006.01)
*C22C 30/00* (2006.01)
*C23C 8/24* (2006.01)

(52) U.S. Cl. ..... 420/439; 420/436; 420/440; 420/586; 148/317; 148/425

(58) Field of Classification Search ..... 420/435–440, 420/586; 148/317, 425
See application file for complete search history.

(56) References Cited

U.S. PATENT DOCUMENTS

| | | | | |
|---|---|---|---|---|
| 2,793,948 | A | 5/1957 | Wagner | |
| 3,650,729 | A | 3/1972 | Kindlimann et al. | |
| 3,837,848 | A | 9/1974 | Wessel | |
| 4,043,839 | A | 8/1977 | Hartline, III et al. | |
| 4,711,763 | A | 12/1987 | Lai | |
| 5,002,731 | A | 3/1991 | Crook et al. | |
| 5,066,459 | A | 11/1991 | Beltran et al. | |
| 5,139,738 | A | 8/1992 | Beltran et al. | |
| 5,182,080 | A | 1/1993 | Beltran et al. | |
| 5,232,662 | A | 8/1993 | Culling | |
| 6,077,615 | A | 6/2000 | Yada et al. | |
| 6,195,864 | B1 | 3/2001 | Chesnes | |
| 6,365,285 | B1 | 4/2002 | Chesnes | |
| 6,478,897 | B1 * | 11/2002 | Izumida et al. | 148/428 |

FOREIGN PATENT DOCUMENTS

| | | | |
|---|---|---|---|
| EP | 1 122 326 | | 8/2001 |
| EP | 1 154 027 | | 11/2001 |
| GB | 2 094 324 | | 9/1982 |
| JP | 48021322 | | 2/1974 |
| JP | 53144411 | | 12/1978 |
| JP | 60009848 | | 1/1985 |
| JP | 60017043 | | 1/1985 |
| JP | 01252751 A | * | 10/1989 |
| JP | 02043344 A | * | 2/1990 |
| JP | 08 283893 | | 10/1996 |
| JP | 08 290933 | | 11/1996 |

OTHER PUBLICATIONS

Masumoto et al., English translation of JP 02-043344A, Feb. 1990.*
Yamanouchi et al., English translation of JP 01-252751A, Oct. 1989.*
"High-Temperature Alloys, ALLOY at a Glance, Haynes alloy 150," Apr. 1992, Haynes International, Inc.
"Corrosion Resistant Alloys, ALLOY at a Glance, Haynes 6B," May 2004, Haynes International, Inc.
"Haynes® 188 Alloy" brochure, 2000, Haynes International, Inc.
"Haynes® 25 Alloy" brochure, 2004, Haynes International, Inc.
Journal of Materials Engineering and Performance, "Wrought Cobalt-Base Superalloys," vol. 2(4), Aug. 1993, pp. 523-530.

* cited by examiner

*Primary Examiner* — Roy King
*Assistant Examiner* — Caitlin Kiechle
(74) *Attorney, Agent, or Firm* — Buchanan Ingersoll & Rooney PC

(57) ABSTRACT

A wroughtable, cobalt alloy capable of through thickness nitridation and strengthening using practical treatments and practical sheet thicknesses contains in weight percent about 23 to about 30% chromium, about 15 to about 25% iron, up to about 27.3% nickel, about 0.75 to about 1.7% titanium, about 0.85 to about 1.9% niobium or zirconium, up to 0.2% carbon, up to 0.015% boron, up to 0.015% rare earth elements, up to 0.5% aluminum, up to 1% manganese, up to 1% silicon, up to 1% tungsten, up to 1% molybdenum, and the balance cobalt plus impurities and the total weight percent of titanium plus niobium or equivalents is from about 1.6 to about 3.6.

11 Claims, 1 Drawing Sheet

COBALT-CHROMIUM-IRON-NICKEL ALLOYS AMENABLE TO NITRIDE STRENGTHENING

FIELD OF THE INVENTION

This invention relates to non-ferrous alloy compositions, and more specifically to wroughtable cobalt alloys that contain significant quantities of chromium, iron, and nickel, and smaller quantities of active solute elements from Groups 4 and 5 of the IUPAC 1988 periodic table (preferably titanium and niobium). Such a combination of elements provides materials that can be cold-rolled into sheets of practical thickness (about 2 mm), shaped and welded into industrial components, then through-nitrided to impart high strengths at high temperatures.

BACKGROUND OF THE INVENTION

For the hot sections of gas turbine engines, three types of so-called "superalloys" are used: solid solution-strengthened nickel alloys, precipitation-hardenable nickel alloys, and solid solution-strengthened cobalt alloys. All of these alloys contain chromium (usually in the range 15 to 30 wt. %), which imparts oxidation resistance. The precipitation-hardenable nickel alloys include one or more of aluminum, titanium, and niobium, to induce the formation of very fine gamma-prime ($Ni_3Al,Ti$) or gamma-double prime ($Ni_3Nb$) precipitates in the microstructure, during aging.

The precipitation-hardenable nickel alloys have two drawbacks. First, they are prone to problems during welding, since the heat of welding can induce the formation of hardening precipitates in heat-affected zones. Second, the gamma-prime and gamma-double prime precipitates are only useful to certain temperatures, beyond which they coarsen, resulting in considerably reduced material strengths. The solid solution-strengthened nickel and cobalt alloys, on the other hand, lack the strength of the precipitation-hardenable nickel alloys, but maintain reasonable strengths at higher temperatures, especially those based on the element cobalt.

Unlike nickel, which has a face-centered cubic (fcc) structure at all temperatures in the solid form, cobalt exists in two forms. At temperatures up to about 420° C., the stable structure is hexagonal close-packed (hcp). Beyond this temperature, up to the melting point, the structure is fcc. This two-phase characteristic is also shared by many cobalt alloys. However, the alloying elements shift the transformation temperature up or down. Elements such as iron, nickel, and carbon are known stabilizers of the fcc form of cobalt and therefore reduce the transformation temperature. Chromium, molybdenum, and tungsten, on the other hand, are stabilizers of the hcp form of cobalt and therefore increase the transformation temperature. These facts are important because they strongly influence the mechanical properties of the cobalt alloys at ambient temperatures.

The reason is that the fcc to hcp transformation in cobalt alloys is sluggish, and, even if the transformation temperature is above ambient, the hcp form is difficult to generate upon cooling. Thus many cobalt alloys possess metastable fcc structures at room temperature. Conversely, the hcp form is easily generated during cold work, the driving force and extent of transformation being related to the transformation temperature. Those metastable cobalt alloys with high transformation temperatures are, for example, difficult to cold work and exhibit high work hardening rates, due to the formation of numerous hcp platelets in their microstructures.

Those metastable cobalt alloys with low transformation temperatures are less difficult to cold work and exhibit much lower work hardening rates.

One of the requirements of wrought, solid solution strengthened cobalt alloys used in gas turbines is that they be capable of at least 30% cold reduction, so that sheets of fine grain size might be produced. Thus, nickel is normally included in such materials, to reduce their transformation temperatures, and in turn to reduce their tendency to transform during cold rolling.

Attempts to use the precipitation of intermetallics (such as gamma-prime) to strengthen cobalt alloys have foundered (equivalent cobalt-rich intermetallics have lower solvus temperatures than gamma-prime). However, an alternate method of strengthening cobalt alloys was disclosed by Hartline and Kindlimann in U.S. Pat. No. 4,043,839. But, this method is useful only for thicknesses regarded as impractical for the construction of gas turbine components (less than 0.025", and preferably less than 0.01"). Their method involved a procedure for absorbing and diffusing nitrogen into cobalt alloys, to induce the formation of a fine dispersion of nitride particles. According to Hartline and Kindlimann, alloys that respond to such treatment contain at least 33% cobalt as the major constituent, chromium, up to 25% nickel, up to 0.15% carbon, and 1 to 3% of nitride forming elements from the group consisting of titanium, vanadium, niobium, and tantalum. Residuals and elements which enhance the properties of cobalt-base alloys, notably molybdenum and boron, were also mentioned. No mention was made of iron, although iron was present at the 1% level in samples successfully nitrided by these inventors. A sample containing 29% nickel, which was less amenable to nitridation, contained 2.7% iron.

SUMMARY OF THE INVENTION

The principal object of this invention is to provide new, wroughtable cobalt "superalloys" capable of through thickness nitridation and strengthening, using treatments of practical duration (approximately 50 hours), for sheet stocks of practical thickness (up to approximately 2 mm, or 0.08 in). Such sheets are capable of stress rupture lives greater than 150 hours at 980° C. (1,800° F.) and 55 MPa (8 ksi), or greater than 250 hours at 980° C. and 52 MPa (7.5 ksi), these being target stress rupture lives during the development of the alloys.

It has been discovered that the above object may be achieved by adding chromium, iron, nickel, and requisite nitride-forming elements (preferably titanium and niobium or zirconium) to cobalt, within certain preferred ranges. Specifically, those ranges in weight percent are about 23 to 30 chromium, about 15 to 25 iron, up to about 27.3 nickel, 0.75 to 1.7 titanium, 0.85 to 1.92 niobium, up to 0.2 carbon, up to 0.012 boron, up to 0.5 aluminum, up to 1 manganese, up to 1 silicon, up to 1 tungsten, up to 1 molybdenum, and up to 0.15 and 0.015 rare earth elements (before and after melting, respectively). The preferred ranges in weight percent are 23.6 to 29.5 chromium, 16.7 to 24.8 iron, 3.9 to 27.3 nickel, 0.75 to 1.7 titanium, 0.85 to 1.92 niobium, up to 0.2 carbon, up to 0.012 boron, up to 0.5 aluminum, up to 1 manganese, up to 1 silicon, up to 1 tungsten, up to 1 molybdenum, and up to 0.15 and 0.015 rare earth elements (before and after melting, respectively). One can substitute equal amounts of zirconium for niobium. Furthermore, one can substitute zirconium or hafnium for a potion of the titanium and some or all of the niobium may be replaced by vanadium or tantalum.

Chromium provides oxidation resistance and some degree of solid solution strengthening. Iron and nickel are fcc stabilizers and therefore counterbalance the chromium (an hcp stabilizer), to ensure a low enough transformation temperature to enable fine-grained sheets to be made by cold rolling. Nickel is known, from the work of Hartline and Kindlimann, to inhibit nitrogen absorption; however, it has been discovered that iron can be used in conjunction with nickel to achieve both the necessary transformation temperature suppression and the necessary nitrogen absorption and diffusion rates to allow practical thicknesses to be strengthened throughout by internal nitridation in practical times.

DETAILED DESCRIPTION OF THE INVENTION

Figure 1:
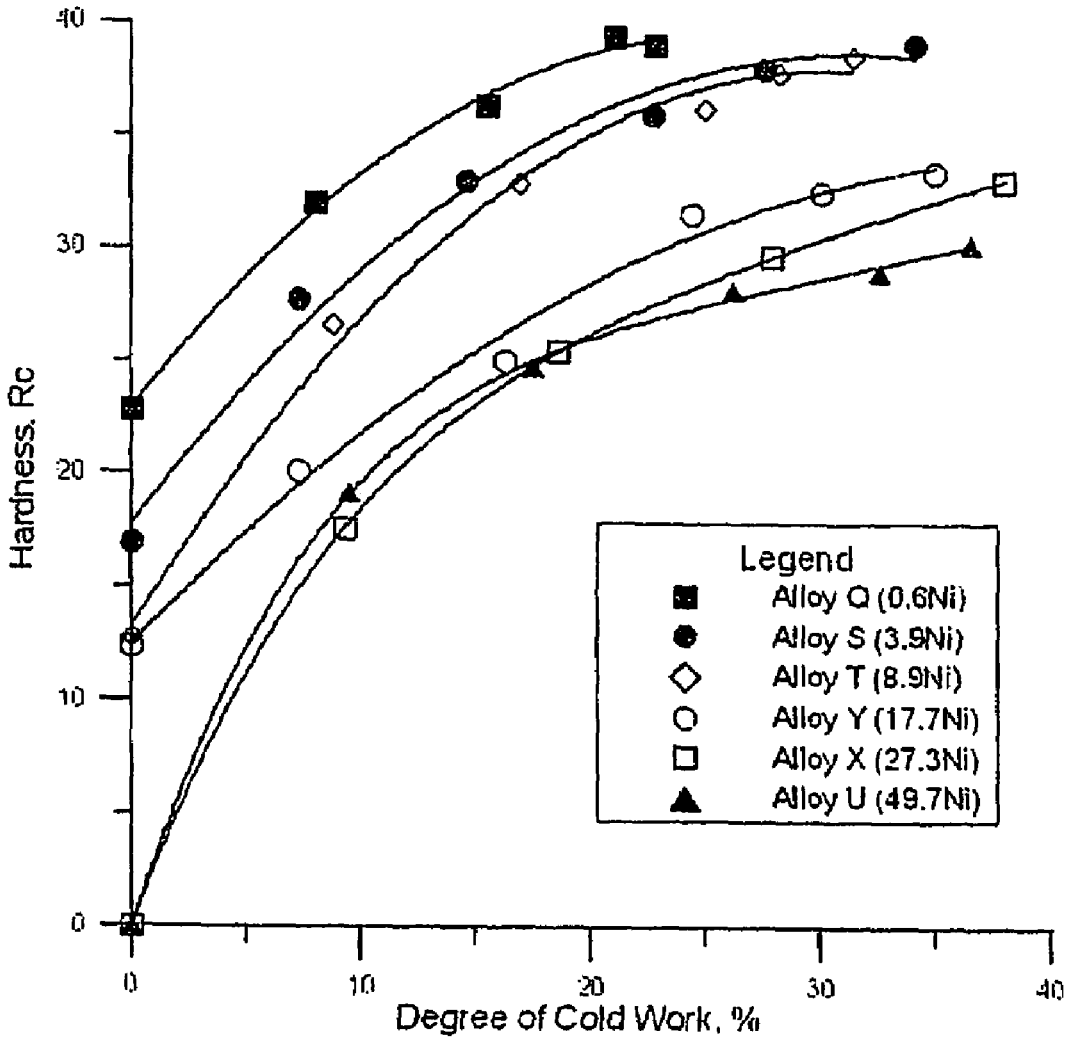
FIG. 1 is a graph showing the hardness of certain of the tested alloys having different nickel contents when cold worked.

To establish the aforementioned preferred compositional ranges, numerous experimental alloys were manufactured in the laboratory, using vacuum induction melting, followed by electro-slag remelting, to yield one 23 kg (50 lb) ingot of each alloy. These ingots were hot forged and hot rolled, at temperatures in the approximate range 1120 to 1175° C. (2,050 to 2,150° F.), to make sheets of thickness 3.2 mm (0.125 in). These were subsequently cold rolled to a thickness of 2 mm (0.08 in).

The nitriding treatment used to strengthen these experimental materials involved 48 hours in a nitrogen atmosphere at 1,095° C. (2,000° F.), followed by 1 hour in an argon atmosphere at 1,120° C. (2,050° F.), followed by 2 hours in an argon atmosphere at 1205° C. (2,200° F.). This had previously been established as the optimum strengthening treatment for alloys of this type.

The compositions of the experimental alloys used to define the preferred ranges are set forth in Table 1. The mechanical properties of these alloys, in the through-nitrided condition, tested at tested at 52 MPa, or 55 MPa and 980° C. (1800° F.) are presented in Table 2. Alloy X and Alloy Y were tested under both conditions. The reason why most alloys were stress rupture tested at 52 MPa, and others at 55 MPa, is that the stress rupture lives of the preferred compositions at 52 MPa were much higher than expected, thus tying up test equipment for much longer times than anticipated. The higher stress (55 MPa) was used to shorten test durations, thus speeding up the development work. The acceptable stress rupture lives, i.e. those that meet the alloy design criteria of 150 hours at 55 MPa or 250 hours at 52 MPa, are marked with an asterisk in Table 2.

It is important to note that the high-chromium Alloy B broke up during forging, establishing that 31.9 wt.% chromium is too high a content to provide wroughtability. Also, through nitridation was not possible in Alloys FF and GG, establishing that either niobium or zirconium should be present, and indicating that higher iron and nickel contents are needed to satisfy the design criteria. Alloy LL is significant in being similar in composition to Example 1 in U.S. Pat. No. 4,043,839 (Hartline and Kindlimann) but a much thicker sample. Alloy LL could not be through-nitrided.

Several of the experimental alloys were used specifically to study the effects of nickel content upon work hardening, an important factor in the production of cold-rolled sheet. The results of this work are given in FIG. 1. A strong relationship was established between hardness (at a given level of cold work) and nickel content, in the range 0.6 to 17.7 wt. %. A low hardness is very beneficial in cold working.

Alloys X and Y were initially tested at 52 MPa and 980° C. (1800° F.) then a second sample of these alloys was tested again at 55 MPa and 980° C. (1800° F.). Both proved acceptable in the first test. Alloy X contained 27.3 wt. % nickel which was believed to be near the upper limit for an acceptable alloy. Alloy Y contained 17.7 wt. % nickel, which was well within what was believed to be an acceptable range for nickel. In the second test Alloy Y ruptured at 330.2 hours, well above the acceptable limit of over 150 hours, but alloy X ruptured after 129.1 hours, just under the acceptable level of 150 hours. From this data we can infer that the upper limit of nickel should be about 27.3 wt. %.

TABLE 1

Chemical Compositions of Experimental Alloys

| Alloy | Co | Cr | Fe | Ni | C | Ti | Nb | Al | Mn | Si | B | Rare Earth |
|---|---|---|---|---|---|---|---|---|---|---|---|---|
| A | 40.9 | 23.6 | 21 | 8 | 0.122 | 1.19 | 1.2 | 0.19 | 0.24 | 0.47 | 0.010 | 0.005 Ce |
| B | 35.6 | 31.9 | 20.8 | 8 | 0.124 | 1.23 | 1.22 | 0.2 | 0.24 | 0.53 | 0.010 | 0.007 Ce |
| C | 43.9 | 27.5 | 16.8 | 7.9 | 0.127 | 1.16 | 1.18 | 0.16 | 0.24 | 0.57 | 0.012 | <0.005 Ce |
| D | 35.6 | 27.7 | 24.8 | 8.2 | 0.128 | 1.21 | 1.21 | 0.11 | 0.24 | 0.58 | 0.010 | 0.006 Ce |
| E | 40.8 | 27.2 | 21.1 | 8.1 | 0.124 | 0.74 | 0.84 | 0.15 | 0.23 | 0.53 | 0.011 | 0.006 Ce |
| F | 38.5 | 27.6 | 21 | 7.8 | 0.108 | 1.7 | 1.92 | 0.18 | 0.25 | 0.61 | 0.010 | 0.005 Ce |
| G | 41.1 | 27.6 | 20.7 | 7.9 | 0.01 | 0.87 | 1.11 | 0.08 | 0.01 | 0.02 | 0.002 | <0.005 Ce |
| H | 39.1 | 27.5 | 20.9 | 8 | 0.207 | 1.3 | 1.22 | 0.41 | 0.92 | 0.97 | 0.011 | <0.005 Ce |
| I | 40.9 | 27.6 | 20.7 | 8 | 0.122 | 1.81 | 0.04 | 0.17 | 0.27 | 0.39 | 0.011 | <0.005 Ce |
| J | 39.1 | 27.5 | 20.8 | 7.9 | 0.129 | 0.02 | 3.51 | 0.07 | 0.26 | 0.32 | 0.005 | <0.005 Ce |
| K | 39.8 | 27.7 | 28.2 | 1.07 | 0.117 | 1.12 | 1.22 | 0.11 | 0.25 | 0.33 | 0.006 | <0.005 Ce |
| L | 41 | 27.4 | 24.8 | 4 | 0.111 | 0.95 | 1.04 | 0.1 | 0.25 | 0.25 | 0.005 | <0.005 Ce |
| M | 40.8 | 27.7 | 16.7 | 11.9 | 0.114 | 0.92 | 1.04 | 0.1 | 0.25 | 0.26 | 0.005 | <0.005 Ce |
| N | 41.2 | 27.7 | 20.7 | 7.9 | 0.082 | 0.89 | 0.94 | 0.09 | 0.25 | 0.11 | 0.005 | <0.005 Ce |
| O | 47.8 | 28 | 21.1 | 0.72 | 0.126 | 1.47 | 0.95 | 0.04 | 0.02 | 0.04 | 0.005 | .005 La |
| P | 49.5 | 28 | 21 | 0.55 | 0.128 | 1.07 | N/A | 0.08 | 0.01 | 0.01 | 0.006 | <0.01 Ce |
| Q | 48.2 | 28.2 | 20.9 | 0.56 | 0.127 | 1.1 | 0.96 | 0.08 | 0.02 | 0.03 | 0.006 | <0.01 Ce |
| R | 46.4 | 27.9 | 20.8 | 1.09 | 0.129 | 1.18 | 1.12 | 0.14 | 0.54 | 0.32 | 0.005 | <0.01 Ce |
| S | 42.9 | 28.1 | 20.8 | 3.9 | 0.127 | 1.3 | 1.13 | 0.22 | 0.56 | 0.33 | 0.005 | <0.01 Ce |
| T | 38.1 | 28.2 | 20.9 | 8.9 | 0.122 | 1.24 | 1.13 | 0.24 | 0.55 | 0.34 | 0.005 | <0.01 Ce |
| U | 0 | 28 | 20.1 | 49.7 | 0.122 | 1.16 | 1.07 | 0.14 | 0.02 | 0.01 | 0.005 | 0.012 Ce |
| V | 29.7 | 28 | 20.2 | 19.7 | 0.134 | 0.92 | 0.03 | 0.21 | 0.52 | 0.4 | 0.007 | 0.01 Ce |
| W | 39.1 | 28.1 | 20.6 | 9.9 | 0.128 | 1.02 | 0.02 | 0.17 | 0.5 | 0.38 | 0.006 | 0.01 Ce |
| X | 19.6 | 27.7 | 21.3 | 27.3 | 0.107 | 1.29 | 1.07 | 0.22 | 0.55 | 0.46 | 0.004 | <0.01 Ce |
| Y | 29.4 | 27.7 | 21.5 | 17.7 | 0.113 | 1.26 | 1.08 | 0.19 | 0.53 | 0.45 | 0.004 | <0.01 Ce |

TABLE 1-continued

Chemical Compositions of Experimental Alloys

| Alloy | Co | Cr | Fe | Ni | C | Ti | Nb | Al | Mn | Si | B | Rare Earth |
|---|---|---|---|---|---|---|---|---|---|---|---|---|
| Z | 38.9 | 27.8 | 21.4 | 7.76 | 0.118 | 1.3 | 1.09 | 0.2 | 0.53 | 0.46 | 0.004 | <0.01 Ce |
| AA | 42.3 | 26 | 18.6 | 8.87 | 0.099 | 1.41 | 1.27 | 0.21 | 0.55 | 0.49 | 0.005 | <0.005 Ce |
| BB | 39.8 | 28.6 | 18.6 | 9 | 0.091 | 1.41 | 1.2 | 0.22 | 0.54 | 0.46 | 0.005 | 0.005 Ce |
| CC | 38.9 | 26.9 | 21.4 | 9.1 | 0.107 | 1.28 | 1.2 | 0.19 | 0.54 | 0.42 | 0.007 | 0.007 Ce |
| DD | 36.6 | 29.5 | 21.4 | 8.9 | 0.103 | 1.25 | 1.15 | 0.18 | 0.54 | 0.44 | 0.006 | 0.010 Ce |
| FF | 59.4 | 27.3 | 10 | 0.76 | 0.131 | 1.58 | 1 | 0.05 | 0.01 | 0.05 | 0.002 | N/A |
| GG | 46.7 | 22 | 19.9 | 9.97 | 0.02 | 1.11 | N/A | 0.05 | 0.01 | 0.02 | N/A | N/A |
| HH | 48 | 28.1 | 20.8 | 1.19 | 0.129 | 1.38 | 1.0 Zr | 0.11 | 0.01 | 0.1 | 0.004 | <0.01 Ce |
| II | 43.3 | 25.9 | 18.6 | 8.9 | 0.105 | 1.15 | 0.96 | 0.18 | 0.53 | 0.43 | 0.006 | 0.008 Ce |
| JJ | 39.9 | 26.7 | 21.3 | 9 | 0.12 | 1.16 | 0.98 | 0.21 | 0.52 | 0.4 | 0.006 | 0.015 Ce |
| KK | 37.3 | 29.3 | 21.3 | 9 | 0.116 | 1.15 | 0.97 | 0.21 | 0.54 | 0.43 | 0.006 | 0.010 Ce |
| LL | 51.2 | 24.8 | 1.07 | 14.9 | 0.035 | 2 | 5 Mo | 0.16 | 0.01 | 0.02 | N/A | N/A |

N/A = No deliberate addition and not analyzed

TABLE 2

High Temperature Mechanical Properties of Experimental Alloys

| Alloy | 980° C./52 MPa Rupture Life, h | 980° C./55 MPa Rupture Life, h |
|---|---|---|
| A | | 355.4* |
| B | BROKE UP DURING FORGING | |
| C | | 261.9* |
| D | | 241.5* |
| E | | 262.5* |
| F | | 447.2* |
| G | | 176.3* |
| H | | 205.1* |
| I | INCOMPLETE PENETRATION | |
| J | | 22.1 |
| K | | 100.3 |
| L | | 190.5* |
| M | | 273.7* |
| N | | 230.4* |
| O | 538.7* | |
| P | 110.6 | |
| Q | 390* | |
| R | 553.5* | |
| S | 496.5* | |
| T | 409* | |
| U | 30.7 | |
| V | 55.1 | |
| W | 87.6 | |
| X | 317.4* | 129.1 |
| Y | 473.6* | 330.2 |
| Z | 764* | |
| AA | | 457.4* |
| BB | | 419.9* |
| CC | | 415* |
| DD | | 174.2* |
| FF | INCOMPLETE PENETRATION | |
| GG | INCOMPLETE PENETRATION | |
| HH | 261.5* | |
| II | | 253.6* |
| JJ | | 271.9* |
| KK | | 141.4 |
| LL | INCOMPLETE PENETRATION | |

Several observations may be made concerning the general effects of the alloying elements, as follows:

Cobalt (Co) was chosen as the base for this new superalloy because it provides the best alloy base for high temperature strength.

Chromium (Cr) is a major alloying element with a dual function. First, sufficient chromium must be present in to provide oxidation resistance. Second, chromium enhances the solubility of nitrogen in such alloys. My experiments indicate that 22 wt. % Cr (Alloy GG) is insufficient for through thickness nitriding. On the other hand, Alloy A having a chromium range of 23.6 wt. % was acceptable. Alloy B containing 31.9 wt. % Cr cannot be hot forged without cracking. Yet, alloy DD, having 29.5 wt. % chromium, was acceptable. This data indicates that the chromium range should be between about 23% and 30%.

Iron (Fe) also has a dual function. First, as a stabilizer of the fcc structure in cobalt, it reduces the transformation temperature of cobalt alloys, thus making them easier to cold roll into sheets. At the same time, it does not reduce the solubility of nitrogen to the same extent that nickel (the other main fcc stabilizer) does; thus it may be regarded as beneficial to nitrogen absorption. The data for Alloy FF indicate that at 10 wt. % iron is insufficient to attain through-nitriding, while Alloy K, with 28.2 wt. % iron, did not meet the strength criterion. Alloy C, containing 16.8% Fe, and Alloy L, containing 24.8 wt. % Fe, were acceptable. Accordingly, the data indicates that iron should be present in an amount between about 15 wt. % and 25 wt. %.

The primary function of nickel (Ni) is to stabilize the fcc form of the alloys, so that they can easily be cold rolled into sheets. As indicated by FIG. 1, there is a strong relationship between hardness (at a given level of cold work) and nickel content. On the other hand, experiments have shown that nickel substantially decreases nitrogen absorption in materials of this type. Thus, a combination of nickel and iron, to suppress the transformation temperature without significant detriment to nitrogen absorption, is a key feature of the alloys of this invention. The hardness versus cold work experiments (FIG. 1) indicate that Alloy Q (0.6 wt. % Ni) is significantly harder than Alloy S (3.9 wt. % Ni). The stress rupture lives indicate that Alloy X (27.3 wt. % Ni) meets the strength requirement, but Alloy U (49.7 wt. % Ni) does not. Alloy O containing only 0.72 wt. % Ni was also acceptable. Thus, the data indicates nickel may be present in amounts up to 27.3 wt. %.

Titanium (Ti) as well as niobium (Nb) or an equivalent amount of vanadium, tantalum or zirconium, are critical to the alloys of this invention, since these elements form the strengthening nitrides. My experiments indicate that both of these elements should be present, within well-defined ranges, to achieve the desired strength levels, or to ensure through-nitriding. Nevertheless, it is possible to use a combination of titanium plus zirconium, without any niobium. The performance of Alloy HH in which zirconium was substituted for niobium indicates that one can substitute equal amounts of zirconium for all or a portion of the needed niobium. Both zirconium and niobium have practically the same molecular weight. It is also possible to substitute zirconium or hafnium for some of the titanium. The amount of each of titanium and niobium or zirconium that must be present depends upon whether and how much of any substitute elements are in the alloy. Zirconium and hafnium are substitute elements for titanium, while vanadium and tantalum are substitute elements for niobium. For example, Alloys P and W (with about 1 wt. % Ti only) are of insufficient strength, while Alloy I (about 1.8 wt. % Ti only) could not be through-nitrided. Also, Alloy J (with about 3.5 wt. % Nb only) was of insufficient strength. My experiments indicate that a combination of 0.75 wt. % Ti and 0.85 wt. % Nb (Alloy E) can be through-nitrided and provides sufficient strength; the same is true for alloys with up to 1.7 wt. % Ti and 1.92 wt. % Nb (Alloy F). Thus, absent any substitute elements titanium should be present at range of 0.75 to 1.7 wt. % and a niobium should be present at a range of 0.85 to 1.92 wt. %. In addition, the combination of titanium and niobium (Ti+Nb) should be from about 1.6 to about 3.6. In the alloys listed in Table 1 Ti+Nb ranges from 1.07 (Alloy P) to 3.126 (Alloy F). At the lower end, Alloy E, 0.74 Ti+0.84 Nb=1.58, meets the criteria for an acceptable composition. But, Alloy V, 0.92 Ti+0.03 Nb=0.95 failed the criteria, indicating the criticality of the combination of titanium and niobium. At the upper end, Alloy F, 1.7 Ti+1.92 Nb=3.62 meets the criteria. With regard to the substitution of titanium and niobium with other active solute elements, it is likely that other elements from Groups 4 and 5 of the IUPAC 1988 periodic table of the elements would provide the same benefits, if present in atomically equivalent amounts. This means the total weight percents will comply with the following equations:

$$0.75 \leqq Ti+Zr/1.91+Hf/3.73 \leqq 1.7$$

$$0.87 \leqq Nb+Zr+V/1.98+Ta/1.98+ \leqq 1.92$$

$$1.6 \leqq Ti+1.52\ Zr+Hf/3.73+Nb+V/1.98+Ta/1.98 \leqq 3.6$$

In Alloy LL molybdenum was substituted for niobium producing an unacceptable alloy. This result also indicates that niobium or zirconium should be presented in the alloy.

Carbon (C) is not essential to the alloys of this invention, but might be useful in small amounts for the control of grain size. My experiments indicate that, at the highest level studied (0.207 wt. %, Alloy H) coarse carbide particles are present in the microstructure. While these did not prevent Alloy H from meeting the acceptance criteria, it is likely that greater quantities of such particles would be detrimental. Thus, a maximum of 0.2 wt. % carbon is acceptable.

Boron (B) is commonly used in cobalt and nickel "superalloys" for grain boundary strengthening. Thus, boron was added to most of the tested alloys at typical levels, i.e. within the range 0 to 0.015 wt. %. The highest level studied was 0.012 which is the level in acceptable Alloy C. This data confirms that boron can be present within a range typical for this type of alloy, that is up to 0.015 wt. %.

Rare Earth Elements such as cerium (Ce), lanthanum (La), and yttrium (Y) are also commonly used in cobalt and nickel "superalloys" to enhance their resistance to oxidation. Thus, Misch Metal (which contains a mixture of Rare Earth Elements, notably about 50 wt. % cerium) was added to most of the experimental alloys. The reactivity of such elements is such that most is lost during melting. However, an addition of 0.1 wt. % Misch Metal led to cerium values as high as 0.015 wt. % (Alloy JJ) in the alloys. Instead of Misch Metal, lanthanum was added to Alloy O. Since Alloy JJ was acceptable we conclude that final Rare Earth Element contents up to 0.015 wt. % are acceptable. Since rare earth elements are commonly lost during melting rare earth metal contents an order of magnitude higher (0.15 wt. %) in the charge materials (prior to melting) should be acceptable.

Aluminum (Al) is not an essential ingredient of the alloys of this invention. However, it is used in small quantities in most wrought, cobalt superalloys to help with deoxidation, during melting. Thus, all the experimental alloys studied during the development of this new alloy system contained small quantities of aluminum (up to 0.41 wt. %, Alloy H). The usual aluminum range for cobalt superalloys is 0 to 0.5 wt. %. The acceptability of Alloy H indicates that the usual range for aluminum in superalloys is acceptable here. Accordingly aluminum may be present up to 0.5 wt %.

Manganese (Mn), like aluminum, is commonly added to the cobalt superalloys in small quantities, in this case for sulfur control. Typical additions range up to 1 wt. %. Manganese levels up to 0.92 wt. % (Alloy H) were studied during the development of this new system. Once again the acceptability of Alloy H confirms that the typical range for manganese in this type of alloy will work here. Manganese can be present up to 1 wt %.

Silicon (Si) is normally present (up to 1 wt. %) in cobalt superalloys as an impurity from the melting process. Levels up to 0.97 wt. % (Alloy H) were studied during the development work. The data indicate that as in other cobalt alloys silicon may be present up to 1 wt %.

Although present in many cobalt superalloys, tungsten (W) and molybdenum (Mo) are not essential ingredients of the alloys of this invention. Indeed, no deliberate additions of these elements are intended. However, it is common for these elements to contaminate furnace linings during cobalt superalloy campaigns, and reach impurity levels during the melting of tungsten- and molybdenum-free materials. Thus, impurity levels of up to 1 wt. % of each of the elements can be present in the alloys of this invention.

The alloy here described will typically be made and sold in sheet form. However, the alloy could be produced and sold in billet, plate bar, rod or tube forms. The thickness of the sheet or other form typically will be between 1 mm and 2 mm (0.04 inches to 0.08 inches).

Although I have described certain present preferred embodiments of my alloy it should be distinctly understood that the invention is not limited thereto but may be variously embodied within the scope of the following claims.

I claim:

1. A wroughtable, cobalt alloy capable of through thickness nitridation and strengthening consisting essentially of in weight percent:

about 23 to about 30% chromium
about 15 to about 25% iron
up to about 27.3% nickel
about 0.75 to about 1.7% titanium
about 0.85 to about 1.9% niobium, zirconium or a combination thereof
up to 0.2% carbon
up to 0.015% boron
up to 0.015% rare earth elements
up to 0.5% aluminum
up to 1% manganese
up to 1% silicon
up to 1% tungsten
up to 1% molybdenum, and
balance cobalt plus impurities wherein titanium +niobium is from about 1.6 to about 3.6%.

2. The alloy of claim 1 wherein the alloy is in a wrought form having a thickness of up to 2 mm.

3. The alloy of claim 1 wherein the alloy has been subjected to a nitriding treatment.

4. The alloy of claim 3 wherein the nitriding treatment is comprised of:

heating the alloy for at least 48 hours in a nitrogen atmosphere at a temperature of 1,095° C.;

then heating the alloy for at least 1 hour in an argon atmosphere at 1,120° C.; and then heating the alloy for at least 2 hours in an argon atmosphere at 1,205° C.

5. A wroughtable, cobalt alloy consisting essentially of in weight percent:

23.6 to 29.5% chromium
16.7 to 24.8% iron
0.56 to 27.3% nickel
0.75 to 1.7% titanium
0.85 to 1.92% niobium
up to 0.2% carbon
up to 0.012% boron
up to 0.015% rare earth elements
up to 0.5% aluminum
up to 0.92% manganese
up to 0.97% silicon
up to 1% tungsten
up to 1% molybdenum; and
balance cobalt plus impurities wherein titanium +niobium is from about 1.6 to about 3.6%.

6. A wroughtable, cobalt alloy capable of through thickness nitridation and strengthening consisting essentially of in weight percent:

about 23 to about 30% chromium
about 15 to about 25% iron
up to about 27.3% nickel
at least one element selected from the group consisting of titanium, zirconium and hafnium such that:

$$0.75 \leqq Ti+Zr/1.91+Hf/3.73 \leqq 1.7$$

at least one element selected from the group consisting of vanadium, niobium, zirconium and tantalum such that:

$$0.87 \leqq Nb+Zr+V/1.98+Ta/1.98 \leqq 1.92$$

up to 0.2% carbon
up to 0.015% boron
up to 0.015% rare earth elements
up to 0.5% aluminum
up to 1% manganese
up to 1% silicon
up to 1% tungsten
up to 1% molybdenum, and
balance cobalt plus impurities wherein the alloy further satisfying the following compositional relationship defined with elemental quantities being in terms of weight percent:

$$1.6 \leqq Ti+1.52Zr+Hf/3.73+Nb+V/1.98+Ta/1.98 \leqq 3.6.$$

7. The alloy of claim 6 wherein the alloy contains in weight percent:

23.6 to 29% chromium
16.7 to 24.8% iron
0.56 to 27.3% nickel
0.75 to 1.7% titanium
0.85 to 1.92% niobium
up to 0.92 manganese, and
up to 0.97 silicon.

8. The alloy of claim 6 wherein zirconium is substituted for at least a portion of the niobium on a one to one basis.

9. The alloy of claim 6 wherein the alloy is in a wrought form having a thickness of up to 2 mm.

10. The alloy of claim 6 wherein the alloy has been subjected to a nitriding treatment.

11. The alloy of claim 10 wherein the nitriding treatment is comprised of:

heating the alloy for at least 48 hours in a nitrogen atmosphere at a temperature of 1,095° C.;

then heating the alloy for at least 1 hour in an argon atmosphere at 1,120° C.; and then heating the alloy for at least 2 hours in an argon atmosphere at 1,205° C.

* * * * *